United States Patent [19]

Hasegawa

[11] Patent Number: 4,864,975

[45] Date of Patent: Sep. 12, 1989

[54] COMPRESSION RATIO-CHANGING DEVICE FOR INTERNAL COMBUSTION ENGINES

[75] Inventor: Shumpei Hasegawa, Wako, Japan

[73] Assignee: Honda Giken Kogyo Kabushiki Kaisha, Tokyo, Japan

[21] Appl. No.: 212,917

[22] Filed: Jun. 29, 1988

[30] Foreign Application Priority Data

Jul. 3, 1987 [JP] Japan ..... 62-167625

[51] Int. Cl.[4] ..... F02D 15/02

[52] U.S. Cl. ..... 123/48 B; 123/78 BA

[58] Field of Search ..... 123/48 R, 48 B, 78 R, 123/78 B, 78 BA, 78 E

[56] References Cited

U.S. PATENT DOCUMENTS

| | | | |
|---|---|---|---|
| 1,637,245 | 7/1927 | Scully | 123/78 E |
| 2,356,033 | 8/1944 | Criddle | 123/78 E |
| 4,515,114 | 5/1985 | Dang . | |
| 4,516,537 | 5/1985 | Nakahara et al. . | |
| 4,602,596 | 7/1986 | Kessler . | |
| 4,721,073 | 1/1988 | Naruoka et al. . | |

FOREIGN PATENT DOCUMENTS

| | | | |
|---|---|---|---|
| 58-91340 | 5/1983 | Japan . | |
| 62-6263 | 1/1987 | Japan . | |
| 0012837 | 1/1988 | Japan | 123/78 BA |

*Primary Examiner*—David A. Okonsky
*Attorney, Agent, or Firm*—Lyon & Lyon

[57] ABSTRACT

A compression ratio-changing device for an internal combustion engine includes a rotary eccentric member rotatably interposed between a piston and a connecting rod, a locking pin for locking the rotary eccentric member to the connecting rod, and a device for driving the locking pin to selectively hold the rotary eccentric member to the connecting rod and release same therefrom. A sliding groove formed in the connecting rod is disposed for parallel alignment with a guide groove formed in the rotary eccentric member when the rotary eccentric member assumes a first angular position for decreasing the volume of a combustion chamber of the engine at a top dead center position of the piston to obtain a higher compression ratio, or a second angular position for increasing the volume of the combustion chamber at the dead center position of the piston to obtain a lower compression ratio. The locking pin is disposed to be held between the guide groove and the sliding groove when the guide groove is in parallel alignment with the sliding groove, thereby locking the rotary eccentric member to the connecting rod.

18 Claims, 11 Drawing Sheets

COMPRESSION RATIO-CHANGING DEVICE FOR INTERNAL COMBUSTION ENGINES

BACKGROUND OF THE INVENTION

This invention relates to a compression ratio changing device for an internal combustion engine, and more particularly to such a device, which can change the compression ratio of the engine by changing the volume of the combustion chamber within the cylinder at the top dead center of the piston.

A compression ratio-changing device of this kind is known e.g. from Japanese Provisional Patent Publication (Kokai) No. 58-91340, in which, as shown in FIG. 1, an eccentric bearing (rotary eccentric member) C is interposed between a piston pin A connected to a piston, not shown, and an end B2 of a connecting rod B remote from a crankshaft, not shown, whereby the position of the piston relative to the connecting rod B can be changed by rotating the eccentric bearing C, thereby changing the volume of the combustion chamber and hence the compression ratio. The eccentric bearing C is locked to and unlocked from the end B2 of the connecting rod B by means of a locking pin D, which is slidably fitted in a guide hole B1 formed in the end B2 of the connecting rod B, and movable in response to oil pressure to be engaged in and disengaged out of a hole C1 formed in the eccentric bearing C.

According to the above conventional arrangement, even when the locking pin D is acted upon by the oil pressure at an end face thereof close to the crankshaft, the locking pin D remains in contact with the outer peripheral surface of the eccentric bearing C without moving, until the rotational angle of the eccentric bearing C, i.e. the piston pin A becomes 90 degrees, as shown in (a)–(c) of FIG. 2, where the eccentric bearing C assumes rotational angles of 0, 30, 60, and 90 degrees, respectively. That is, the locking pin D is not moved as indicated by the points (a)–(c) on the broken line in FIG. 10. When the rotational angle of the piston pin A becomes 90 degrees, the locking pin D rushes into the hole C1, as shown in (d) of FIG. 2, that is, the position of the locking pin D is abruptly changed from the point (d) to the point (e) shown in FIG. 10. At this time, the locking pin D is acted upon by a great bending stress and a great shearing stress produced by the inner peripheral surface of the hole C1, which is disadvantageous in maintaining the strength and durability of the locking pin D.

If, in order to eliminate the disadvantage, the length along which the locking pin D is to be engaged in the hole C1 is shortened, there is a fear of disengagement of the locking pin D from the hole C1 when the locking pin D is given a strong impact by the inner peripheral surface of the hole C1, whereby the eccentric bearing C cannot be firmly locked by the locking pin D.

Another compression ratio-changing device is known e.g. from the Japanese Utility Model Publication (Kokai) No. 62-6263, in which is formed an oil chamber acting as a buffer for mitigating the impact from the hole C1.

However, also in the latter conventional device, the locking pin is disposed to abruptly rush into the hole C1 formed in the eccentric bearing during rotation of the eccentric bearing, similarly to the former conventional device. Therefore, according to the prior art, it is difficult to prevent the looking pin from being acted on by the great bending stress and shearing stress, and hence to firmly and smoothly lock the eccentric member, under various operating conditions of the engine. There is the same disadvantage as mentioned above with another type of compression ratio-changing device in which an eccentric piston pin is used as the eccentric member instead of the eccentric bearing, interposed between the piston and an end of the connecting rod remote from the crank shaft.

SUMMARY OF THE INVENTION

It is the object of the invention to provide a compression ratio-changing device for internal combustion engines, in which the locking pin for locking the rotary eccentric member is not acted upon by a great stress to firmly and smoothly lock the rotary eccentric member in position for obtaining a predetermined compression ratio, to thereby have a prolonged life.

According to the invention, there is provided a compression ratio-changing device for an internal combustion engine having a crankshaft, at least one cylinder, at least one piston slidably received within the at least one cylinder, at least one combustion chamber defined between the at least one piston and the at least one cylinder, at least one connecting rod connecting the crankshaft to the at least one piston, a rotary eccentric member rotatably interposed between each of the at least one piston and each of the at least one connecting rod, the rotary eccentric member being disposed to assume a first angular position for decreasing the volume of the combustion chamber at a top dead center position of the piston to obtain a higher compression ratio, and a second angular position for increasing the volume of the combustion chamber at the dead center position of the piston to obtain a lower compression ratio, at least one locking pin for locking the rotary eccentric member to the connecting rod, and means for driving the locking pin to selectively hold the rotary eccentric member in the first angular position or in the second angular position and release same therefrom. The compression ratio-changing device is characterized by the improvement wherein: the rotary eccentric member has an outer peripheral surface thereof formed with a guide groove extending tangentially to the outer peripheral surface; the connecting rod has a sliding surface in sliding contact with the rotary eccentric member, the sliding surface having a sliding groove formed therein, the sliding groove being disposed for parallel alignment with the guide groove of the rotary eccentric member when the rotary eccentric member assumes the first angular position or the second angular position; and the locking pin is disposed to be held between the guide groove and the sliding groove when the guide groove is in parallel alignment with the sliding groove, thereby locking the rotary eccentric member to the connecting rod.

The invention will be more apparent from the ensuing detailed description taken in conjunction with the accompanying drawings.

Figure 2:
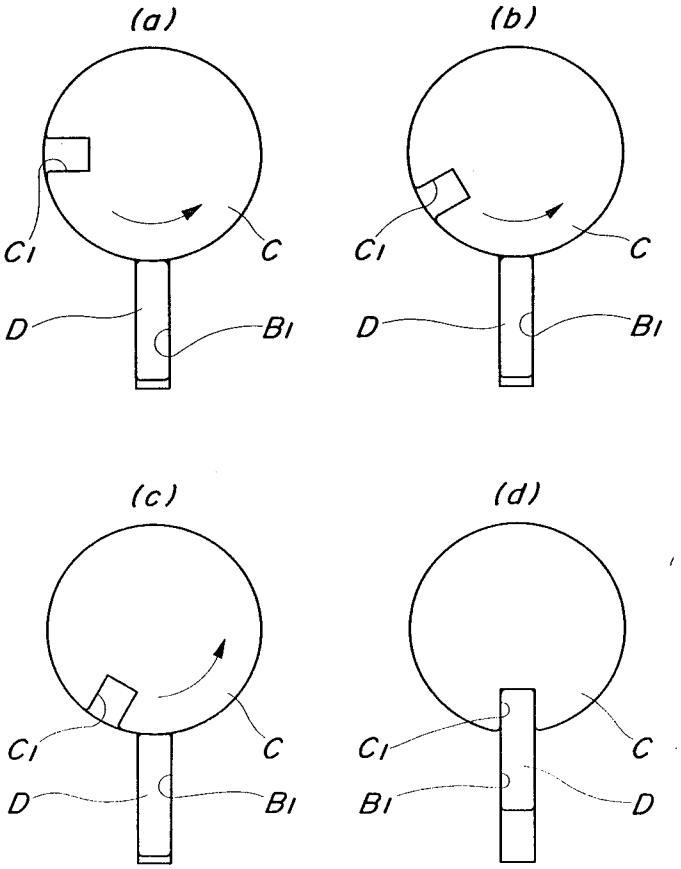
FIG. 2 PRIOR ART
Figure 1:
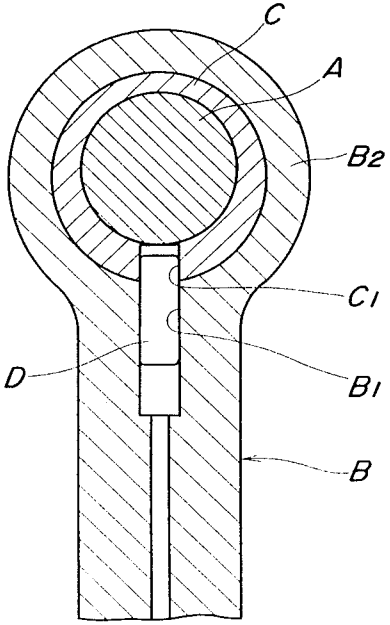
FIG. 1 PRIOR ART
FIG. 1 is a longitudinal sectional view of a conventional compression ratio-changing device.
Figure 3:
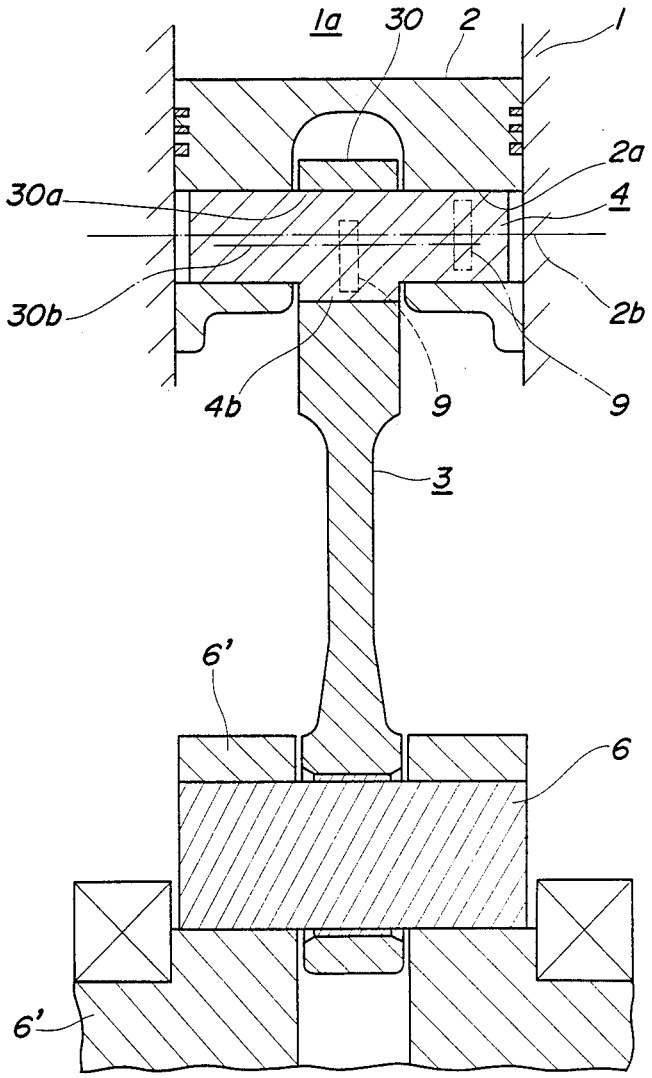
Figure 4:
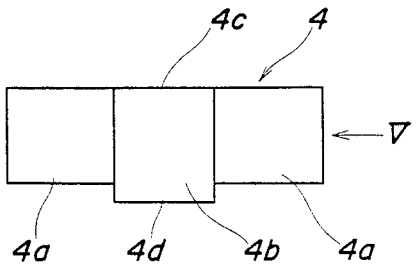
Figure 5:
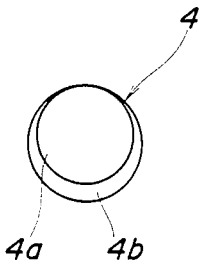
Figure 6:
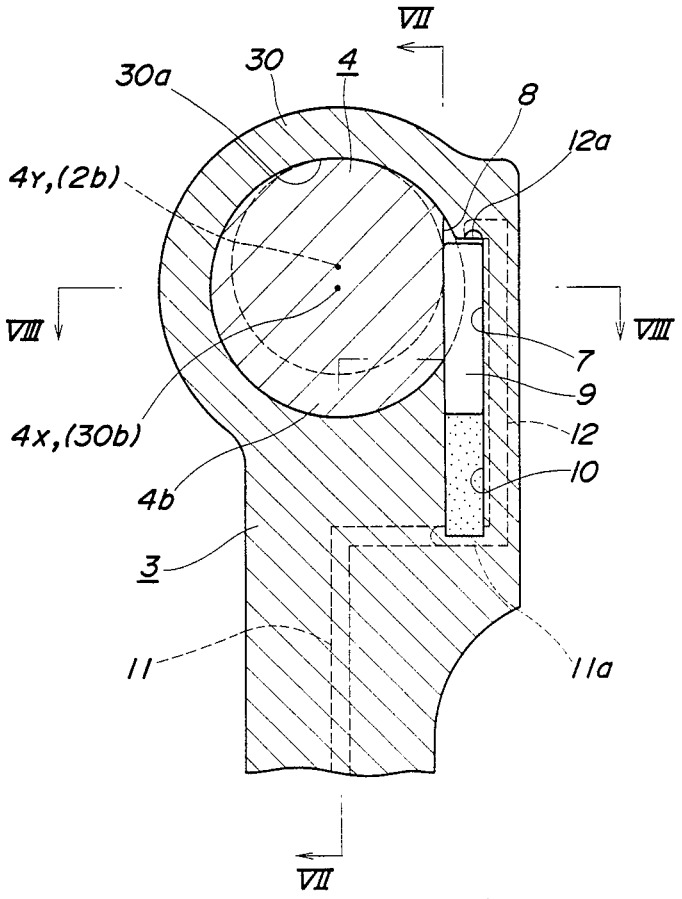
Figure 7:
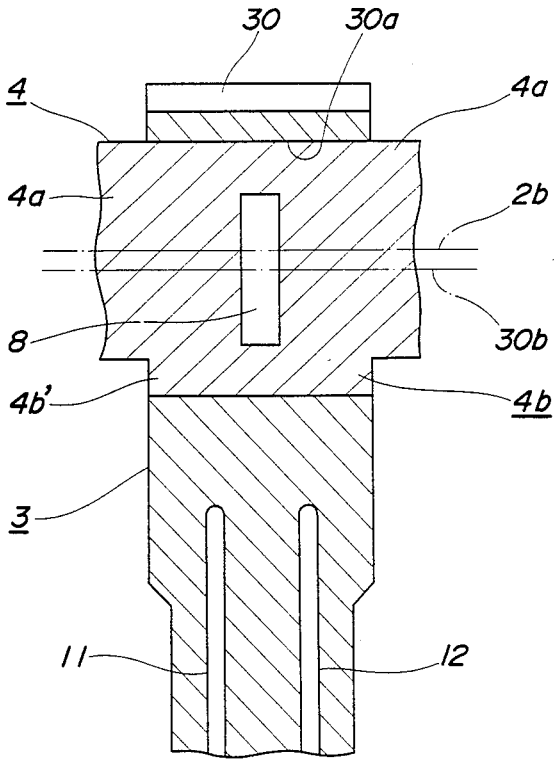
Figure 8:
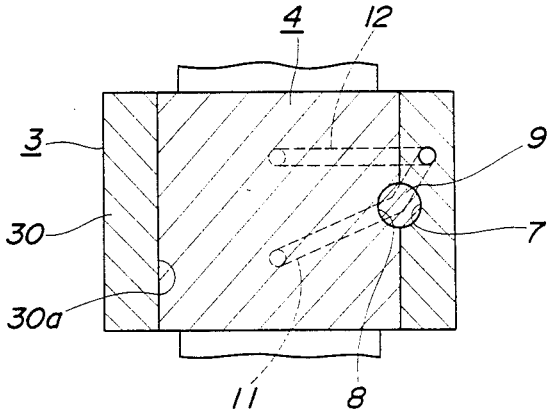
Figure 9:
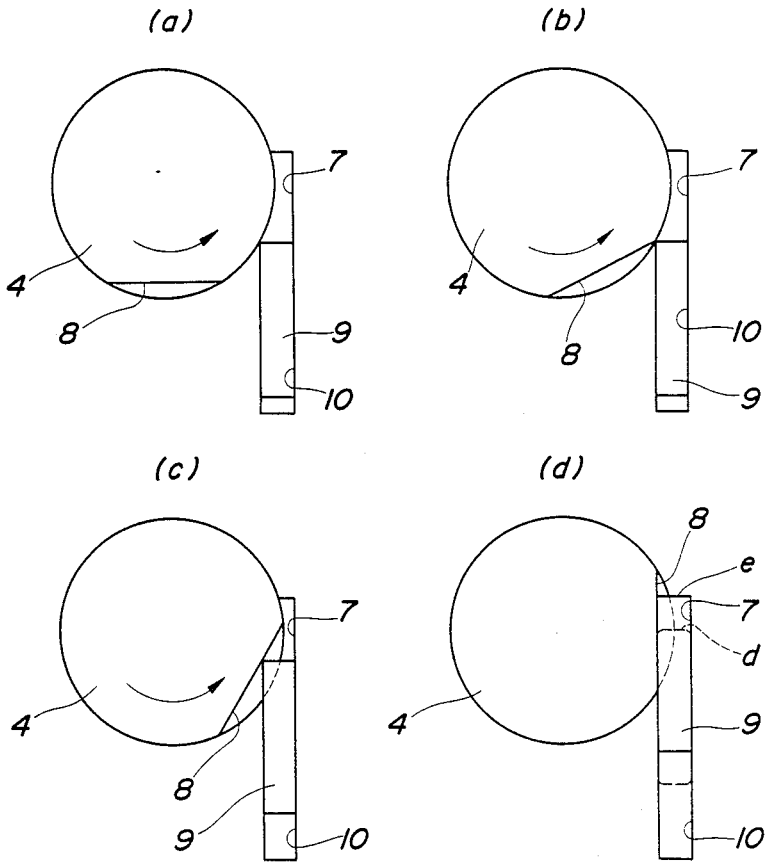
Figure 10:
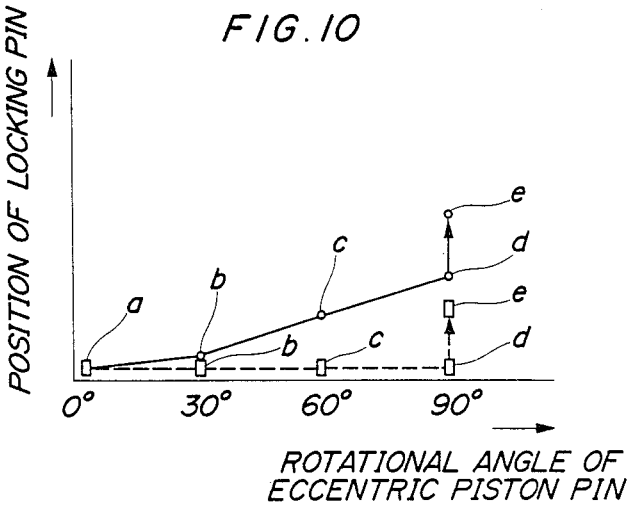
Figure 11:
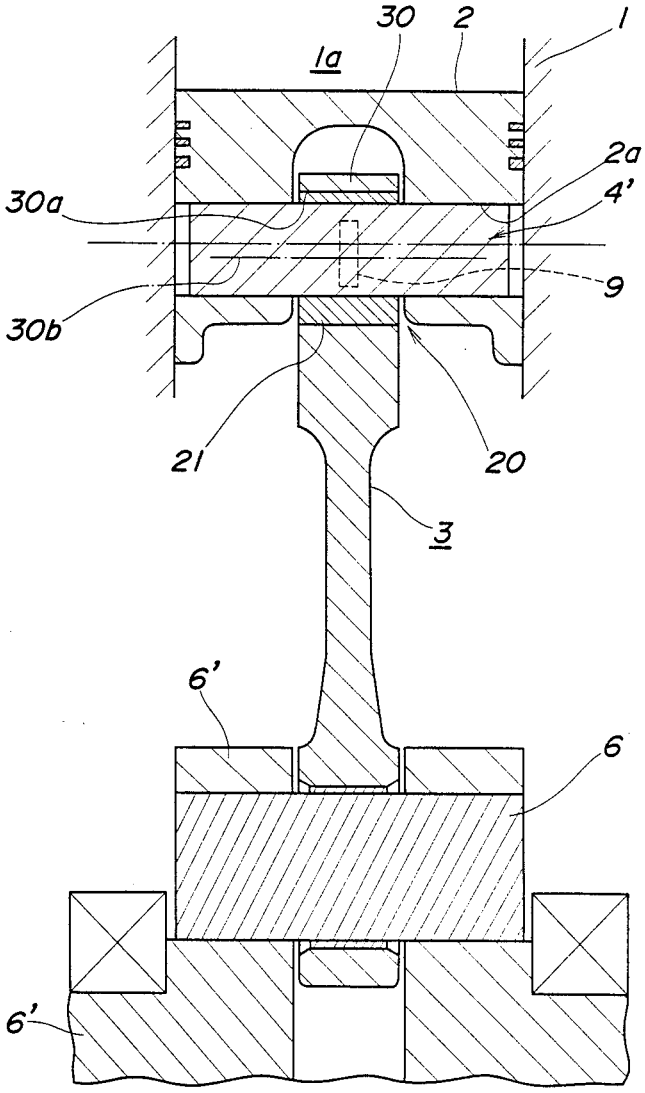
Figure 12:
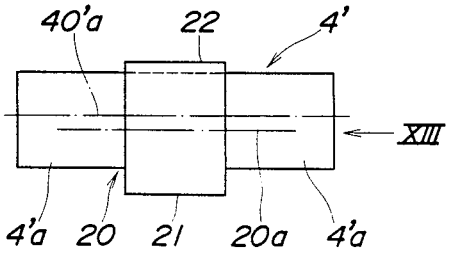
Figure 13:
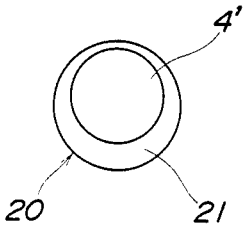
Figure 14:
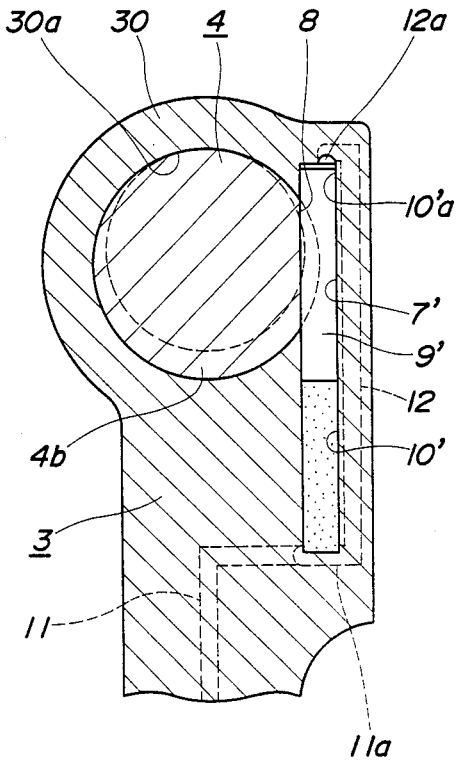
Figure 15:
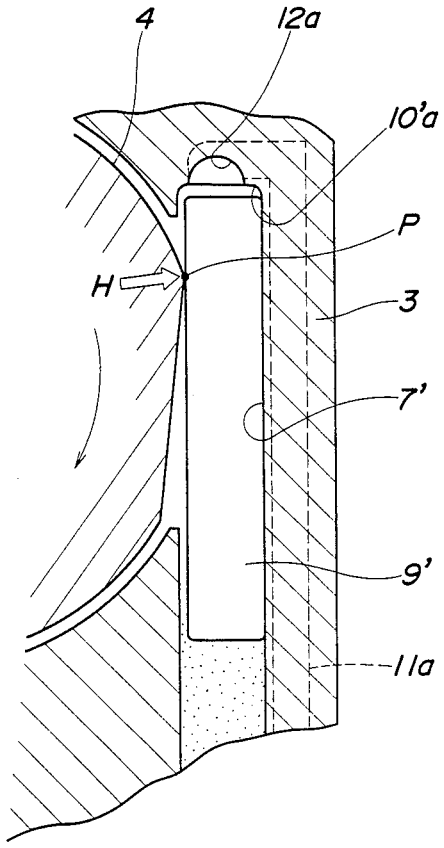
Figure 17:
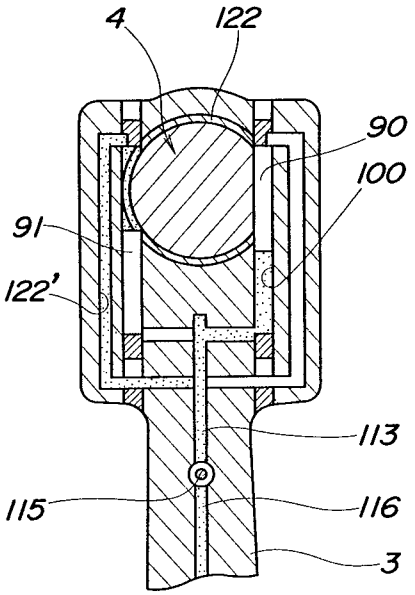
Figure 16:
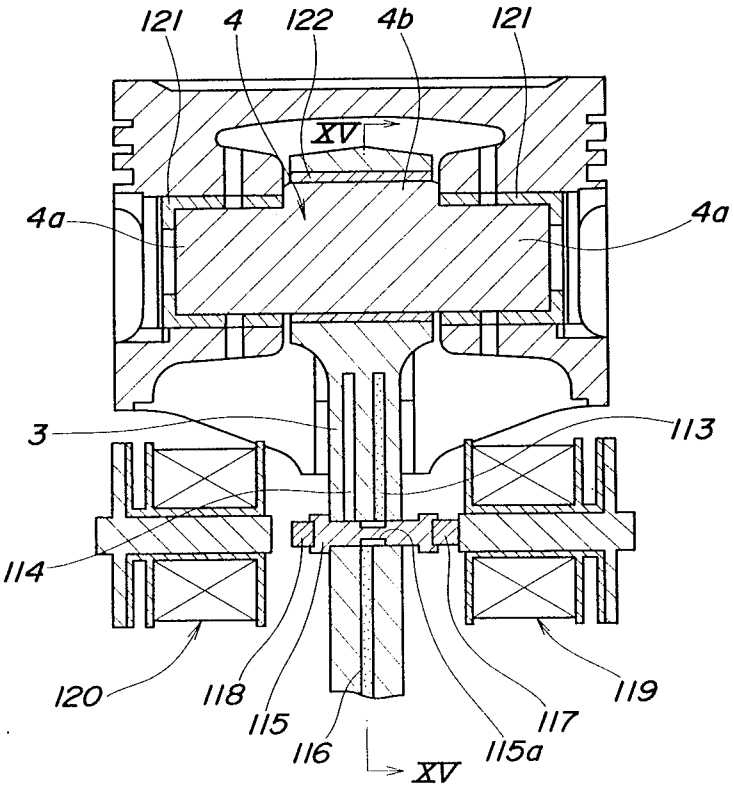
Figure 18:
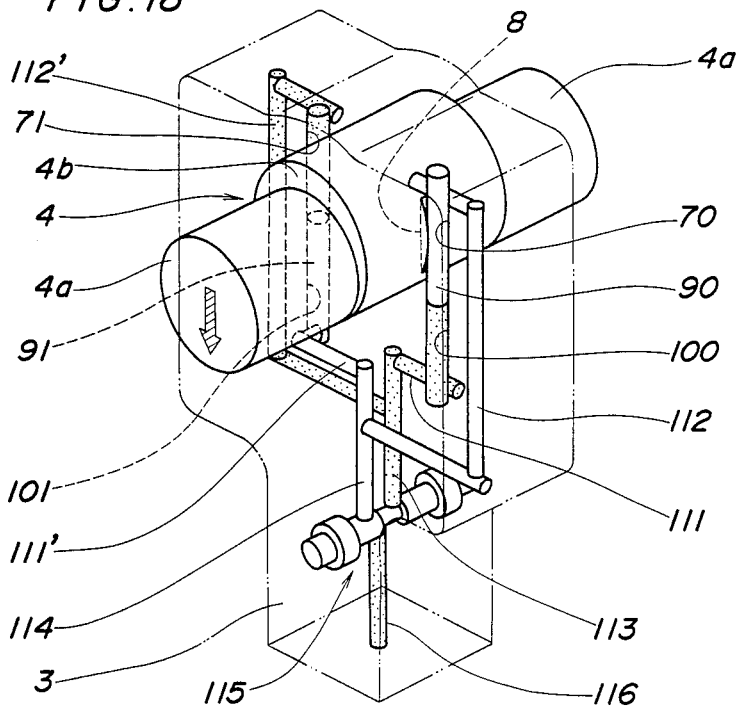
Figure 19:
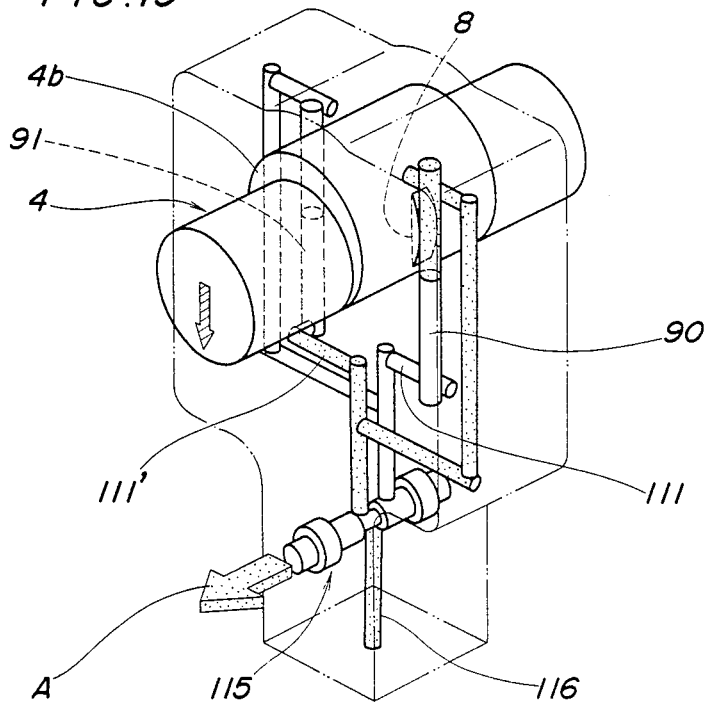
Figure 20:
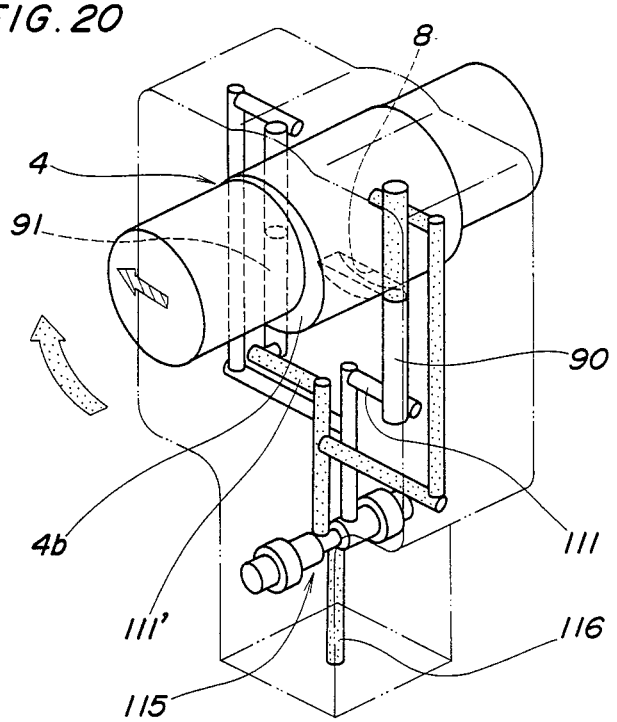
Figure 21:
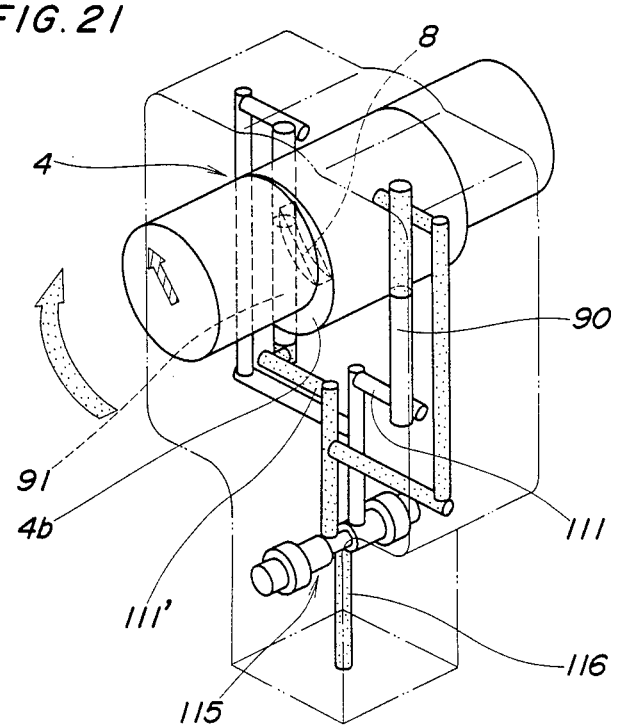
Figure 22:
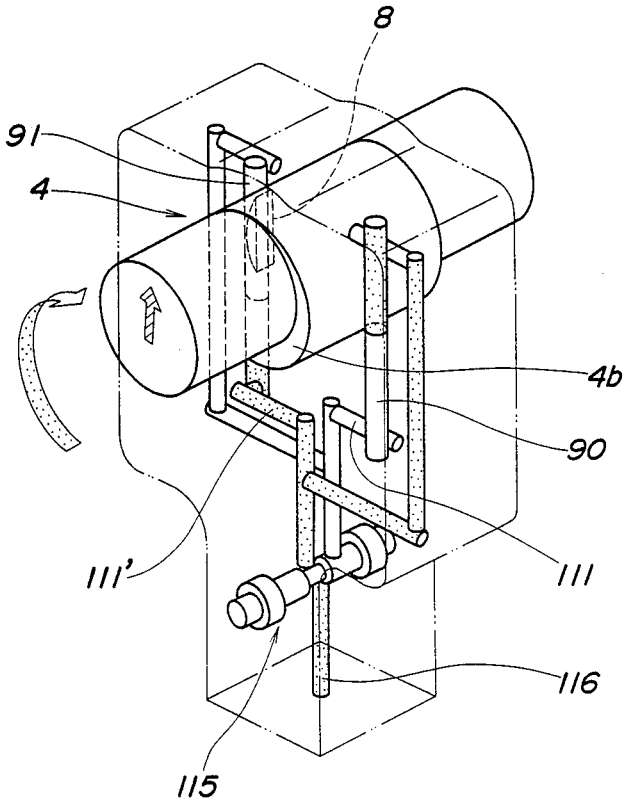

(a)–(d) of FIG. 2 are views useful in explaining the operation of the device in FIG. 1;

FIG. 3 is a longitudinal sectional view of a compression ratio-changing device for an internal combustion engine, which employs an eccentric piston pin, according to a first embodiment of the invention;

FIG. 4 is a plan view of the eccentric piston pin in FIG. 3;

FIG. 5 is a view taken as viewed from the direction of the arrow V in FIG. 4;

FIG. 6 is a transverse sectional view of essential parts of the compression ratio-changing device in FIG. 3;

FIG. 7 is a transverse sectional view taken along line VII—VII in FIG. 6;

FIG. 8 is a transverse sectional view taken along line VIII—VIII in FIG. 6;

(a)-(d) of FIG. 9 are views useful in explaining the operation of the eccentric piston pin in FIG. 3;

FIG. 10 is a graph showing the relationship between the rotational angle of the eccentric piston pin and the position of a locking pin for locking the eccentric piston pin;

FIG. 11 is a longitudinal sectional view of a compression ratio-changing device for an internal combustion engine, which employs an eccentric bush, according to a second embodiment of the invention;

FIG. 12 is a plan view of the eccentric bush in FIG. 11;

FIG. 13 is a view taken as viewed from the direction of the arrow XIII in FIG. 12;

FIG. 14 is a view similar to FIG. 6, showing a third embodiment of the invention;

FIG. 15 is a view useful in explaining the operation of the third embodiment;

FIG. 16 is a sectional view showing the whole construction of a fourth embodiment of the invention;

FIG. 17 is a transverse sectional view taken along line XVII—XVII in FIG. 16;

FIG. 18 is a schematic perspective view of the fourth embodiment in a position for obtaining a lower compression ratio:

FIG. 19 is a similar view to FIG. 18, in which a spool assumes a different position from that in FIG. 18 to change the connection between oil passages;

FIG. 20 is a similar view to FIG. 18, in which the eccentric piston pin has been rotated by 90 degrees in a clockwise direction from the circumferential position shown in FIG. 19;

FIG. 21 is a similar view to FIG. 18, in which the eccentric piston pin has been further rotated by 45 degrees in the clockwise direction from the circumferential position shown in FIG. 20; and FIG. 22 is a similar view to FIG. 18, in which the eccentric piston pin has been rotated by 180 degrees in the clockwise direction from the circumferential position shown in FIG. 18, into a position for obtaining a higher compression ratio.

DETAILED DESCRIPTION

The invention will now be described in detail with reference to the drawings showing embodiments thereof. Throughout all the the figures, corresponding or similar elements or parts are designated by identical reference numerals, and detailed description thereof is made only in describing a first embodiment and omitted in describing second through fourth embodiments.

Referring first to FIG. 3 through FIG. 10, the first embodiment of the invention will be described. In FIG. 3, reference numeral 1 designates a liner wall of a cylinder of an internal combustion engine, within which a piston 2 is received for reciprocating motion therein. A connecting rod 3 is connected to the piston 2. An eccentric piston pin rotary eccentric member) 4 is rotatably interposed between the piston 2 and the connecting rod 3. As shown in FIGS. 4–6, the eccentric piston pin 4 has opposite cylindrical reduced-diameter end portions 4*a*, 4*a* thereof rotatably fitted in a bore 2*a* formed through the piston 2, and a cylindrical increased-diameter intermediate portion 4*b* thereof integral with the opposite end portions 4*a*, 4*a* and rotatably fitted through a bore 30*a* formed through the connecting rod 3. The common axis 4*y* (shown in FIG. 6) of the end portions 4*a*, 4*a* which is coincident with the axis 2*b* of the bore 2*a*, is offset relative to the axis 4*x* (FIG. 6 of the intermediate portion 4*b*, which is coincident with the axis 30*b* of the bore 30*a*. Further, the reduced-diameter end portions 4*a*, 4*a* and increased-diameter intermediate portion 4*b* have respective outer peripheral surfaces thereof extending parallel with the respective axes thereof, and forming an axially straight surface 4*c* at one side, while forming an arcuate projection 4*d* at the opposite side, as best shown in FIG. 4.

When the projection 4*d* of the intermediate portion 4*b* is on a side close to a crank pin 6 connected to a crankshaft 6'as shown in FIG. 3, the piston 2 has a top dead center thereof positioned relatively remotely from the crank pin 6, so that a combustion chamber 1*a* has a reduced volume at the top dead center position to thereby achieve a higher compression ratio within the cylinder. On the other hand, when the projection 4*d* is on the opposite side remote from the crank pin 6, the top dead center position of the piston 2 is displaced relatively close to the crank pin 6, so that the volume of the combustion chamber 1*a* is increased at the top dead center position to thereby achieve a lower compression ratio within the cylinder.

As shown in FIGS. 6 through 8, the eccentric piston pin 4 has an outer peripheral surface thereof formed with a guide groove 8 extending tangentially to the outer periphery and having a semicircular bottom surface. On the other hand, the connecting rod 3 has a sliding groove 7 formed therein in such a position and direction that the sliding groove 7 is aligned with the guide groove 8 in a manner being parallel therewith when the piston pin 4 is locked. The connecting rod 3 is further formed therein with a hole 10 continuously extending straight from an end of the sliding groove 7 close to the crank pin 6 and toward the crank pin 6, as shown in FIG. 6. Slidably received within the hole 10 is a pin 9 for locking the eccentric piston pin 4.

The hole 10 has an end close to the crank pin 6 connected to an open end 11*a* of an oil passage 11 formed in the connecting rod 3, which supplies oil pressure for locking the eccentric piston pin 4. The oil passage 11 is connected to a lubricating oil passage, not shown, in the crank pin 6 and supplies oil pressure therefrom into the hole 10 to act upon the end of the locking pin 9 close to the crank pin 6. On the other hand, the sliding groove 7 has an end thereof remote from the crank pin 6 connected to an open end 12*a* of an oil passage 12 formed in the connecting rod 3 for unlocking the eccentric piston pin 4. The oil passage !2 is connected to the oil passage 11. Oil pressure supplied from the lubricating oil passage through the oil passage 12 acts upon the end of the locking pin 9 remote from the crank pin 6. In this first embodiment, the open end 12*a* of the unlocking oil passage 12 is located side closer to the crank pin 6 than the end of the guide groove 8 remote from the crank pin 6, when the guide groove 8 is aligned with the sliding groove 7.

The operation of the first embodiment of the invention will now be explained.

The eccentric piston pin 4 is rotated, in response to a change in the crank angle, by an inertia force acting on the piston 2 and the connecting rod 3 and gas pressure within the cylinder. The rotational speed and direction depends upon the sizes of various components forming the engine and operating conditions of the engine. For example, let it be assumed that the eccentric piston pin 4 rotates counterclockwise as viewed in FIG. 6 and the rotational angle of the piston pin 4 is 0 degree when the guide groove 8 of the eccentric piston pin 4 is in a position at right angles relative to the axis of the locking pin 9 at the side close to the crank pin 6, that is, in a position shown in (a) of FIG. 9.

When the end of the locking pin 9 close to the crank pin 6 is acted upon by the oil pressure at 0 degree of the rotational angle of the eccentric piston pin 4, the locking pin 9 begins to move in a direction away from the crank pin 6. Before the guide groove 8 reaches the end of the locking pin 9 remote from the crank pin 6, the end of the pin 9 remains in contact with the outer peripheral surface of the eccentric piston pin 4, so that the locking pin 9 does not move and the eccentric piston pin 4 continues to rotate.

When the rotational angle of the pin 4 becomes 30 degrees, as shown in (b) of FIG. 9, part of the guide groove 8 begins to face the sliding groove 7, whereupon the end of the locking pin 9 remote from the crank pin 6 is brought in engagement with the guide groove 8, and the locking pin 9 in the hole 10 begins to be moved by the oil pressure in the direction away from the crank pin 6. Also in this position, the eccentric piston pin 4 continues to rotate.

When the rotational angle of the eccentric piston pin 4 becomes 60 degrees, as shown in (c) of FIG. 9, the locking pin 9 continues to move in the same direction, while the eccentric piston pin 4 still continues to rotate as well.

When the rotational angle of the pin 4 becomes 90 degrees, as shown in (d) of FIG. 9, the guide groove 8 is aligned with the sliding groove 7 in a manner being parallel therewith, while the end of the locking pin 9 remote from the crank pin 6 moves into a space defined between the grooves 7 and 8 to reach a position d indicated by the broken line in (d) of FIG. 9, whereupon the eccentric piston pin 4 stops rotating. On this occasion, the locking pin 9 is held between the grooves 7 and 8, a stress acting upon the locking pin 9 is borne by the whole outer peripheral surface of the held portion thereof, thereby preventing stress concentration on a small area of the outer peripheral surface of same. Further, the stress acting thereon is neither a shearing stress nor a bending stress, but a compression stress, which is advantageous in substantially enhancing the strength and durability of the locking pin.

Even after the eccentric piston pin 4 stops rotating, the oil pressure continues to act upon the locking pin 9, so that the locking pin 9 still continues to move until the end thereof remote from the crank pin 6 abuts against the end of the sliding groove 7 remote from the crank pin 6, i.e. a position e shown in (d) of FIG. 9. In this position, the locking pin 9 is held in position relative to the connecting rod 3, thereby achieving the higher compression ratio.

As described above, while the eccentric piston pin 4 rotates from the angular position of 0 degree to the angular position of 90 degrees, the eccentric piston pin 4 gently varies in position over a considerably long period of time, from the position a to the position e, as indicated by the solid line in FIG. 10 (whereas the broken line indicates a change in the position of the conventional eccentric piston pin). This also reduces an impact acting upon the locking pin 9.

Therefore, according to the first embodiment of the invention, the locking pin is substantially enhanced in impact strength and durability, and at the same time the looking of the rotary eccentric member by means of the locking pin can be achieved smoothly and firmly.

When the end of the looking pin 9 remote from the crank pin 6 is acted upon by oil pressure through the unlocking oil passage 12, the locking pin 9 begins to move in an opposite direction toward the crank pin 6 along the sliding groove 7 and into the hole 10. This allows the eccentric piston pin 4 to rotate clockwise as viewed in FIG. 6, whereby the bottom surface of the guide groove 8 urges the locking pin 9 in the direction toward the crank pin 6, which causes smooth movement of the locking pin 9 for unlocking the eccentric piston pin 4. When the eccentric piston pin 4 rotates back to the position (a) in FIG. 9, where the locking pin 9 has wholly moved out of the sliding groove 7, the eccentric piston pin 4 is unlocked to thereby achieve the lower compression ratio.

Although in the embodiment described above, the looking pin 9 is arranged at a location indicated by the broken line in FIG. 3, i.e. at the increased-diameter portion **4*b* of the eccentric piston pin 4, this is not limitative to the invention, but the looking pin 9 may be arranged at a location indicated by the one-dot chain line in FIG. 3, i.e. at one of the reduced-diameter portions 4*a***.

FIGS. 11 through 13 show a second embodiment of the invention.

According to the second embodiment, an eccentric bush 20 as the rotational eccentric member is interposed between a piston pin 4' and the end portion 30 of the connecting rod 3.

The piston pin 4' has a truely cylindrical shape with substantially the same diameter over the whole length thereof. The pin 4' has opposite end portions **4'*a*, 4'*a* thereof rotatably fitted in the bore 2*a* formed in the piston 2, similarly to the first embodiment. Interposed between the piston pin 4' and the end portion 30 of the connecting rod 3 is the eccentric bush 20 in a manner being rotatable relative to the piston pin 4' and the end portion 30. Specifically, the eccentric bush 20 is rotatably fitted in a bush bore 30*a* formed through the end portion 30 of the connecting rod 3, and is rotatably fitted on a central portion of the piston pin 4. The eccentric bush 20 has a radially outward swelling 2 at a lateral side thereof. The axis 20*a* of the eccentric bush 20, which is coincident with the axis 30*b* of the bush bore 30*a*, is therefore offset relative to the axis 40'*a* of the piston pin 4', which is coincident with the axis 2*b* of the bore 2*a***.

When the eccentric bush 20 assumes such an angular position that the swelling 21 is on a side close to the crank pin 6 as shown in FIG. 11, the top dead center position of the piston 2 is relatively remote from the crank pin 6, so that the volume of the combustion chamber !a is reduced at the top dead center position to thereby achieve the higher compression ratio. On the other hand, when the swelling 21 is on the opposite side remote from the crank pin 6, the top dead center position of the piston 2 is relatively close to the crank pin 6, so that the volume of the combustion chamber 1*a* is increased at the top dead center position to thereby achieve the lower compression ratio.

The other component elements and parts of the second embodiment not referred to above may be substantially identical in construction and arrangement with corresponding ones of the first embodiment, except that the guide groove 8 is tangentially formed in the outer peripheral surface of the eccentric bush 21. Therefore, as the locking pin 9 slidably received in the hole 10 formed in the connecting rod 3 moves out of the hole 10, it holds the eccentric bush 20 in position relative to the connecting rod 3 while it is held between the sliding groove 7 and the guide groove 8.

With the above described construction of the second embodiment, when the guide groove 8 of the eccentric bush 20 is brought into parallel alignment with the sliding groove 7 of the connecting rod 3 with rotation of the eccentric bush 20, the locking pin 9 is held between the grooves 7 and 8, thereby locking the eccentric bush 20. Also in the second embodiment, similarly to the first embodiment, an impact stress acted upon the locking pin 9 when it is held between the groove 7 and 8 is borne by the whole outer peripheral surface of the held portion of the locking pin 9, so that stress concentration on a small area of the outer peripheral surface of same is prevented. Further, the stress is neither a shearing stress nor a bending stress, but a compression stress, being also advantageous in substantially enhancing the strength and durability of the device.

FIGS. 14 and 15 show a third embodiment, in which the guide groove 8 is formed in the outer peripheral surface of the eccentric piston pin 4, similarly to the first embodiment. The third embodiment is distinguished from the first embodiment in that an additional hole 1O'*a* is formed in the connecting rod 3, which is axially aligned with and continuously extends from an end of a sliding groove 7' remote from the crank pin 6, i.e. at an opposite side to an opposite hole 10' formed in the connecting rod 3, and a locking pin 9' is longer than the guide groove 8. The locking pin 9' is wholly received within the hole 10' when the eccentric piston pin 4 is unlocked, while an end of the locking pin 9 remote from the crank pin 6 is inserted in the hole 10'*a* when the eccentric piston pin 4 is locked. The other component elements and parts of the third embodiment may be similar to those of the first embodiment.

The operation of the third embodiment according to the invention will be explained.

When the guide groove 8 of the eccentric piston pin 4 is brought into parallel alignment with the sliding groove 7' of the connecting rod 3 with rotation of the eccentric piston pin 4, the locking pin 9' is held between the grooves 7 and 8, thereby locking the eccentric piston pin 4. At this time, the locking pin 9' has its end remote from the crank pin 6 inserted into the hole 10'*a*, and is disposed along part of the hole 10' and the grooves 7 and 8, and the opposite hole 10'*a*. Therefore, when the locking pin 9' is held between the grooves 7 and 8, the impact stress acted upon the locking pin 9' is borne by the whole outer peripheral surface of the increased held portion of the locking pin 9', so that stress concentration on a small area of the outer peripheral surface of same is prevented, and further the stress is neither a shearing stress nor a bending stress, but a compression stress. Thus, the third embodiment employing the locking pin 9' longer than the locking pin 9 of the first embodiment is more advantageous than the first embodiment in substantially enhancing the strength and durability of the device.

The operation of the third embodiment will be further explained more in detail with reference to FIG. 15.

Once the end of the locking pin 9' remote from the crank pin 6 is inserted into the hole 10'*a* with counterclockwise rotation of the eccentric piston pin 4 to lock the eccentric piston pin 4, even if the eccentric piston pin 4 tends to rotate clockwise or backward, an end edge p of the guide groove 8 forming the border line between the groove 8 and the outer peripheral surface of the eccentric piston pin 4 abuts against the outer peripheral surface of the locking pin 9', whereby the locking pin 9' is acted upon by a force in a direction transverse to the axis of the locking pin 9', i.e. in a direction indicated by the arrow H, so that the locking pin 9' will not be moved only by the rotation of the eccentric piston pin 4, that is, once locked, eccentric piston pin 4 will never be spontaneously unlocked.

Further, according to the above described third embodiment, when the locking pin 9' is moved in the direction toward the crank pin 6 in order to unlock the eccentric piston pin 4 from a locked state as shown in FIG. 5, by the oil pressure applied to the locking pin 9' from the open end 12*a* of the unlocking oil passage 12, the leakage amount of the oil through a gap formed between the eccentric piston pin 4 and the connecting rod 3 can be limited to a very small amount, by virtue of the existence of the hole 10'*a*, thereby enabling prompt unlocking movement of the locking pin 9'.

FIGS. 16 through 22 show a fourth embodiment of the invention.

According to the fourth embodiment, similarly to the first embodiment, the guide groove 8 is formed tangentially in the outer peripheral surface of the increased-diameter portion 4*b* of the eccentric piston pin 4. The fourth embodiment is distinguished from the first embodiment in that two locking pins 90 and 91 are employed, and the connecting rod 3 has a pair of sliding grooves 70, 71 formed therein at diametrically opposite locations with respect to the eccentric piston pin 4 interposed therebetween, as shown in FIG. 18. The sliding grooves 70 and 71 are so disposed as to align with the guide groove 8 with rotation of the eccentric piston pin 4. Further formed in the connecting rod 3 are holes 100 and 101 extending continuously with ends of the respective sliding grooves 70, 71 close to the crank pin 6, for accommodating locking pins 90 and 9!.

The holes 100, 101 have ends thereof close to the crank pin 6 communicated respectively with first and second oil passages 111, 111' formed in the connecting rod 3 for supplying oil pressure for locking the locking pins 90. 91. The sliding grooves 70, 71 have ends thereof remote from the crank pin 6 communicated respectively with first and second oil passages 112, 112' formed in the connecting rod 3 for supplying oil pressure for unlocking the locking pins 90, 91. The first locking oil passage 111 and the second unlocking oil passage 112' are communicated with a first common oil passage 113 formed in the connecting rod 3, while the first unlocking oil passage 112 and the second locking oil passage 111' are communicated with a second common oil passage 1144 formed in the connecting rod 3. Respective ends of the first and second common oil passages 113, 114 close to the crank pin 6 are communicated, through a spool 115 provided across the connecting rod 3, with a main oil passage 116 formed in the connecting rod 3 for supplying lubricating oil to the crank pin 6, etc.

The spool 115 has a central portion thereof formed with an annular oil groove 115*a*, and opposite ends thereof mounted with permanent magnets 117, 118. The spool 115 is disposed to be actuated by actuating means comprising electromagnets 119, 120 provided in the cylinder, to move in directions at right angles to the axis of the connecting rod 3, i.e. in a direction parallel with the axis of the eccentric piston pin 4, so as to selectively connect the main oil passage 116 with the first common oil passage 113 and the second common oil passage 114, through the annular oil groove 115*a*. The opposite reduced-diameter portions 4*a*, 4*a* and the central increased-diameter portion 4*b* of the eccentric piston pin 4 are covered with antifriction metal bearings 121, 122, respectively. The other component elements and parts of the fourth embodiment not referred to above may be identical in construction and arrangement to those of the first embodiment.

The fourth embodiment constructed as above operates as follows: When the compression ratio-changing device is to change from a locked position for lower compression ratio, as shown in FIG. 18, to a locked position for higher compression ratio, the spool 115 is moved by the driving means in a direction indicated by the arrow A of FIG. 19, thereby interrupting the communication of the main oil passage with the first common oil passage 113, and instead communicating the main oil passage with the second common oil passage 114. At this time, the first locking pin 90 is moved toward the crank pin 6 to be wholly received within the hole 100, while an end of the second locking pin 91 remote from the crank pin 6 remains in contact with the outer peripheral surface of the eccentric piston pin 4, i.e. the second locking pin 91 does not move.

Subsequently, when the eccentric piston pin 4 rotates through about 90 degrees in the clockwise direction as shown in FIG. 20, the guide groove 8 also rotates through about 90 degrees in the clockwise direction. At this time, respective ends of the first and second locking pins 90, 91 remote from the crank pin 6 remain in contact with the outer peripheral surface of the eccentric piston pin 4, i.e. neither of the pins 90, 91 moves.

When the eccentric piston pin 4 further rotates through about 45 degrees in the clockwise direction, from the above circumferential position shown in FIG. 20 to a circumferential position shown in FIG. 21, the guide groove 8 confronts the end of the second locking pin 91 remote from the crank pin 6, whereupon the second locking pin 91 begins to be gradually moved away from the crank pin 6, by oil pressure through the second locking oil passage 111'.

Finally, when the the eccentric piston pin 4 further rotates in the clockwise direction through about 180 degrees from the circumferential position shown in FIG. 18 to a circumferential position shown in FIG. 22, the guide groove 8 confronts the sliding groove 71, so that the second locking pin 91 becomes held between the guide groove 8 and the sliding groove 71 and hole 101, whereupon the eccentric piston pin 4 stops its rotation. At this time, the arcuate projection 4*d* of the central increased-diameter portion 4*b* is positioned close to the crank pin 6, to obtain the high or compression ratio. During the higher compression ratio operation, the second locking pin 91 is held between the grooves 7 and 8, where the impact stress i.e. compression stress acting upon the second locking pin 91 is borne by the whole outer peripheral surface of the held portion thereof, similarly to the first embodiment, so that stress concentration on a small area of the outer peripheral surface of same is prevented, substantially enhancing the strength and durability of the device.

Further, according to the fourth embodiment of the invention constructed as above, by virtue of the selective collaboration of the two locking pins, the higher and lower compression ratio states within the cylinder can be achieved more smoothly and more firmly than the previous embodiments, without an excessive stress being applied to the locking pins. Also in the fourth embodiment the eccentric bush 21 employed in the second embodiment can also be used as the rotary eccentric member, instead of the eccentric piston pin 4.

What is claimed is:

1. In a compression ratio-changing device for an internal combustion engine having a crankshaft, at least one cylinder, at least one piston slidably received within said at least one cylinder, at least one combustion chamber defined between said at least one piston and said at least one cylinder, at least one connecting rod connecting said crankshaft to said at least one piston, a rotary eccentric member rotatably interposed between each of said at least one piston and each of said at least one connecting rod, said rotary eccentric member being disposed to assume a first angular position for decreasing the volume of said combustion chamber at a top dead center position of said piston to obtain a higher compression ratio, and a second angular position for increasing the volume of said combustion chamber at said dead center position of said piston to obtain a lower compression ratio, at least one locking pin for locking said rotary eccentric member to said connecting rod, and means for driving said locking pin to selectively hold said rotary eccentric member in said first angular position or in said second angular position and release same therefrom, the improvement wherein: said rotary eccentric member has an outer peripheral surface thereof formed with a guide groove extending tangentially to said outer peripheral surface; said connecting rod has a sliding surface in sliding contact with said rotary eccentric member, said sliding surface having a sliding groove formed therein, said sliding groove being disposed for parallel alignment with said guide groove of said rotary eccentric member when said rotary eccentric member assumes said first angular position or said second angular position; and said locking pin is disposed to be held between said guide groove and said sliding groove when said guide groove is in parallel alignment with said sliding groove, thereby locking said rotary eccentric member to said connecting rod.

2. A compression ratio-changing device as claimed in claim 1, including a hole formed in said connecting rod and extending continuously from an end of said sliding groove close to said crankshaft, said locking pin being disposed to move into or out of said hole, said rotary eccentric member being unlocked from said connecting rod when said locking pin is in an extreme position in said hole close to said crank shaft.

3. A compression ratio-changing device as claimed in claim 2, further including a second hole formed in said connecting rod and extending continuously from an end of said sliding groove remote from said crankshaft, said locking pin being disposed to partially move into or out of said second hole, said locking pin being longer than said guide groove, said rotary eccentric member being locked to said connecting rod when said locking pin is partially received in said second hole.

4. A compression ratio-changing device as claimed in claim 2 or claim 3, including a first oil passage communicating with said first-mentioned hole for supplying oil pressure for urgingly displacing said locking pin into said sliding groove, and a second oil passage communicating with said sliding groove for supplying oil pressure for urgingly displacing said locking pin into said first-mentioned hole.

5. A compression ratio-changing device as claimed in claim 4, wherein said second oil passage opens into said second hole.

6. In a compression ratio-changing device for an internal combustion engine having a crankshaft, at least one cylinder, at least one piston slidably received within said at least one cylinder, at least one combustion chamber defined between said at least one piston and said at least one cylinder, at least one connecting rod connecting said crankshaft to said at least one piston, a rotary eccentric member rotatably interposed between each said piston and each said connecting rod, said rotary eccentric member being disposed to assume a first angular position for decreasing the volume of said combustion chamber at a top dead center position of said piston to obtain a higher compression ratio, and a second angular position for increasing the volume of said combustion chamber at said dead center position of said piston to obtain a lower compression ratio, at least one looking pin for locking said rotary eccentric member to said connecting rod, and means for driving said locking pin to selectively hold said rotary eccentric member in said first angular position or in said second angular position and release same therefrom, the improvement wherein: said rotary eccentric member has an outer peripheral surface thereof formed with a guide groove extending tangentially to said outer peripheral surface; said connecting rod has a sliding surface in sliding contact with said rotary eccentric member said sliding surface having a pair of sliding grooves formed therein at diametrically opposite locations with respect to said rotary eccentric member, said sliding grooves being alternately disposed for parallel alignment with said guide groove of said rotary eccentric member respectively when said rotary eccentric member assumes said first angular position and when said rotary eccentric member assumes said second angular position; and said at least one locking pin comprises a pair of locking pins disposed to be held between said guide groove and respective ones of said sliding grooves, when said guide groove is in parallel alignment with said respective ones of said sliding grooves, thereby locking said rotary eccentric member to said connecting rod.

7. A compression ratio-changing device as claimed in claim 6, including a pair of holes formed in said connecting rod and extending continuously from ends of said respective ones of said sliding grooves close to said crankshaft, said looking pins being disposed to move into or out of respective ones of said holes, said rotary eccentric member being unlocked from said connecting rod when each of said locking pins are in an extreme position in a corresponding one of said holes close to said crank shaft.

8. A compression ratio-changing device as claimed in claim 7, further including a pair of second holes formed in said connecting rod and extending continuously from ends of said respective ones of said sliding grooves remote from said crankshaft, said locking pins being disposed to partially move into or out of respective ones of said second holes, said locking pins being longer than said guide groove, said rotary eccentric member being locked to said connecting rod when each of said locking pins are partially received in a corresponding one of said second holes.

9. A compression ratio-changing device as claimed in claim 7 or claim 8, including first and second oil passages communicating with respective ones of said first-mentioned holes for supplying oil pressure for urgingly displacing said locking pins associated with said respective ones of said first-mentioned holes into said respective ones of said sliding grooves, and third and fourth oil passages communicating with said respective ones of said sliding grooves for supplying oil pressure for urgingly displacing said locking pins associated with said respective ones of said first-mentioned holes into said respective ones of said first-mentioned holes.

10. A compression ratio-changing device as claimed in claim 9, wherein said third and fourth oil passages open into said respective ones of said second holes.

11. A compression ratio-changing device as claimed in claim 9, including a first common oil passage with which said first and third oil passages are communicated, a second common oil passage with which said second and fourth oil passages are communicated, and a spool valve arranged for selectively supplying oil pressure into said first and second common oil passages.

12. A compression ratio-changing device as claimed in any one of claims 1–3, or 6–8, wherein said piston has a bore formed therethrough in which said rotary eccentric member is fitted, said rotary eccentric member having an axis thereof about which said eccentric member rotates, said bore having an axis thereof offset relative to said axis of said rotary eccentric member.

13. A compression ratio-changing device as claimed in claim 12, wherein said eccentric member has opposite reduced-diameter end portions and an intermediate increased-diameter portion having an axis thereof offset to said axis of said bore.

14. A compression ratio-changing device as claimed in claim 13, wherein said guide groove is formed in said intermediate increased-diameter portion.

15. A compression ratio-changing device as claimed in claim 13, wherein said guide groove is formed in at least one of said opposite reduced-diameter end portions.

16. A compression ratio-changing device as claimed in claim 13, wherein said intermediate increased-diameter portion is formed integrally with said opposite reduced-diameter end portions.

17. A compression ratio-changing device as claimed in claim 13, wherein said intermediate increased-diameter portion is formed separately from said opposite reduced-diameter end portions.

18. A compression ratio-changing device as claimed in claim 17, wherein said intermediate increased-diameter portion is formed of an eccentric bush.

* * * * *